United States Patent [19]

Grosjean

[11] Patent Number: 5,034,932

[45] Date of Patent: Jul. 23, 1991

[54] WATCH CASE OVERLAID WITH A CAP HOOKED TO THE CASEBAND

[75] Inventor: Laurent Grosjean, Neuchätel, Switzerland

[73] Assignee: ETA S.A. Fabriques d'Ebauches, Bienne, Switzerland

[21] Appl. No.: 381,529

[22] Filed: Jul. 18, 1989

[30] Foreign Application Priority Data

Jul. 19, 1988 [CH] Switzerland ..... 02761/88

[51] Int. Cl.[5] ..... G04B 37/00

[52] U.S. Cl. ..... 368/286; 368/281; 368/283

[58] Field of Search ..... 368/294–296, 368/282, 283, 286

[56] References Cited

U.S. PATENT DOCUMENTS 4,831,606 5/1989 Aellen ..... 368/286

*Primary Examiner*—Bernard Roskoski

*Attorney, Agent, or Firm*—Griffin Branigan & Butler

[57] ABSTRACT

The watch case (1) of this invention includes a caseband-bezel (2) of plastic material overlaid with a metal cap (5). The cap is a metallic leaf formed to match the relief of the bezel (15) and caseband (16) which it overlays. The cap is secured to the caseband-bezel by tabs (50) folded into receptacles (51) provided by the caseband-bezel.

1 Claim, 2 Drawing Sheets

WATCH CASE OVERLAID WITH A CAP HOOKED TO THE CASEBAND

This invention concerns a watch case including a caseband-bezel forming a first element of the case, a crystal secured to the caseband-bezel and a cap covering entirely the bezel and extending at least partially over the length of the side of the caseband, the cap constituting a second element of said case.

BACKGROUND OF THE INVENTION

Watch cases have often been proposed overlaid by a cap.

Patent No. CH-A-558 040 describes a watch case including a protective cap of extra hard material. In this construction the cap is maintained in place by screws perpendicular to the plane of the case traversing the caseband-bezel and being taken up in threaded studs carried under the cap. Here the cap exhibits a rather complicated cross-section in view of these threaded studs. The caseband-bezel must be in a special form in order to be adapted to the cap which overlays it.

Patent No. CH-A-517 963 (U.S. Pat. No. 3,242,664) describes a watch case overlaid by a cap of metallic carbide made of an annular portion surrounding the crystal and two diametrally opposed ears covering the attachment lugs of a bracelet. The annular portion and the ears are respectively brazed onto the case and the lugs. This construction requires special tooling in order to secure the cap onto the watch case and it will be noted that once the cap has been attached, it may no longer be removed, at least not with the employment of simple tools.

The case described in U.S. Pat. No. 4,396,298 contains an electronic module for displaying time. This case includes a back, an elastic portion interposed between the back and the module and a cover. Elastic pins engaged in flanges of the back maintain the module in the back of the case. The same pins serve to attach the cover to the back. The bracelet is fastened to the case by means of ears raised in the back. This construction is complicated and requires several formed and drawn parts. The cover does not properly speaking constitute a cap but rather a basic portion of the case.

Patent Nos. CH-B-352 965, CH-B-358 039 and DE-A-2 753 (equivalent to U.S. Pat. No. 4,186,552) all describe a thin metallic cap overlaying a caseband formed of plastic material. However in each of these documents the caseband is moulded in a single operation to the interior of the cap which renders the cap inseparable once this operation has been effected. In contrast to this and for reasons which will appear hereinafter, the cap of this invention is positioned on a caseband manufactured separately, then hooked to the caseband.

Patent No. CH-B-352 966 shows a cap, not of metal as in the present invention, but of plastic material, the interior surface of this cap being covered with metallization of small thickness. Besides constituting a difficult construction, it will be noted that the outer portions of the cap made of soft material are subject to rapid deterioration (scratches, etc.).

SUMMARY OF THE INVENTION

In order to avoid the difficulties listed above, the watch case according to this invention, in addition to corresponding to the generic definition given hereinabove, is characterized in that the first element is formed of plastic material, the second element is formed of a metallic leaf formed so as to match the relief of the bezel and caseband which it overlays, and in that projections are formed on one of these elements, said projections being adapted to cooperate with the other element when the cap is put into place on the caseband-bezel in order to assure hooking of said elements to one another and the securing of said cap onto said caseband-bezel.

The advantages of such an arrangement will appear clearly following reading of the description and examination of the drawings which illustrate the invention by way of example.

DESCRIPTION OF THE PREFERRED EMBODIMENT

Figure 1:
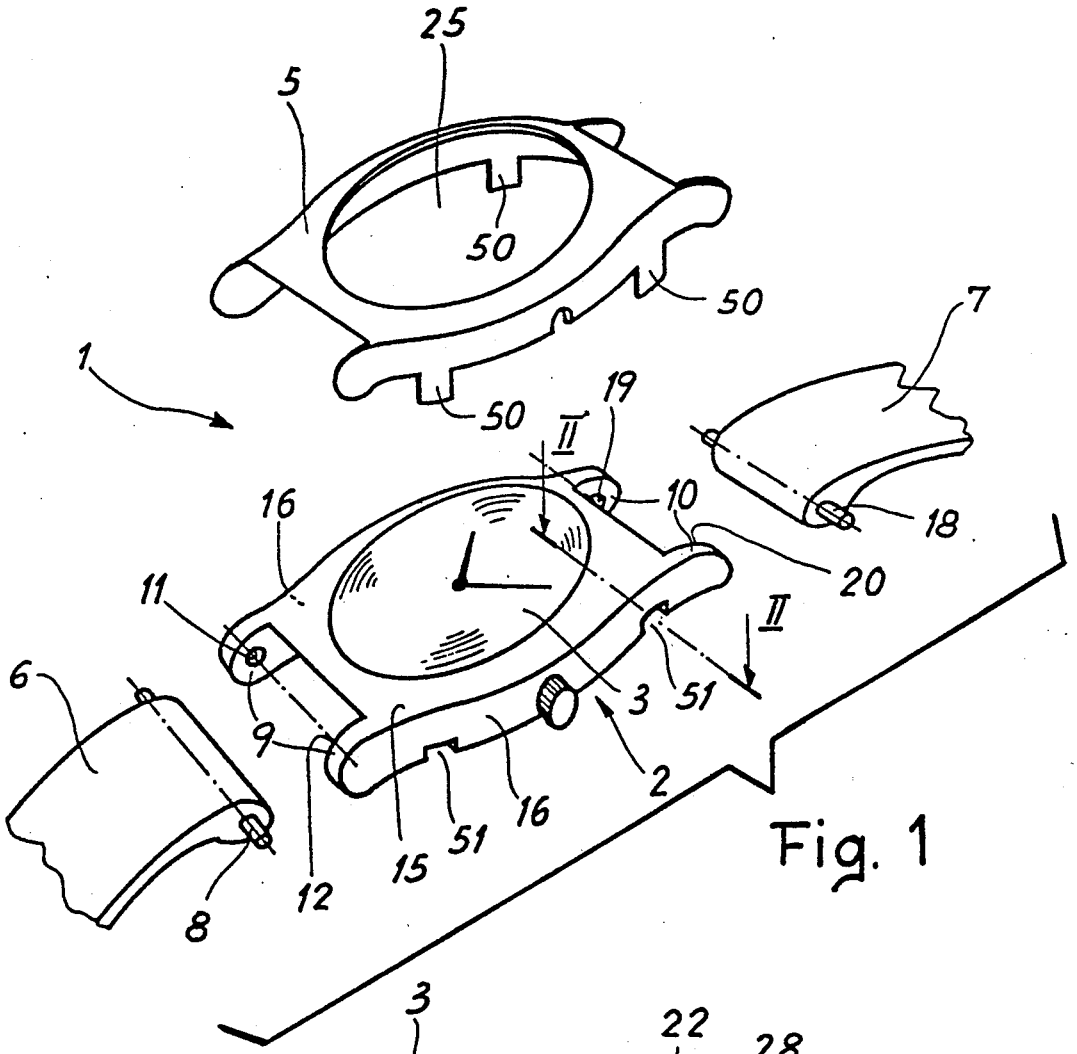
FIG. 1 is an exploded perspective view of the watch case according to the invention in accordance with a first embodiment thereof.

The watch case 1 of FIG. 1 includes essentially a caseband-bezel 2, a crystal 3 secured to the caseband-bezel and a cap 5 adapted to overlay entirely the bezel portion 15 of the caseband-bezel 2, such cap extending at least partially over the length of the side of the caseband portion 16 of the caseband-bezel 2. On FIG. 1 it is seen that the caseband-bezel includes two pairs of lugs 9 and 10 between which are articulated respectively the half bracelets 6 and 7. Half bracelet 6 is articulated around a bar 8 threaded into holes 11 and 12 provided in lugs 9. In the same manner, half bracelet 7 is articulated around a bar 8 threaded into holes 19 and 20 provided in lugs 10.

As may be readily seen on FIG. 1 and in accordance with a characteristic of the invention, the cap 5 comprises a metallic leaf formed in a manner to match the relief of the bezel 15 and of the side of the caseband 16 which it overlays. The forming of the cap may comprise several stages, for instance a preliminary blanking followed by drawing. From these operations there issues the cap 5 with its opening 25, the contour of the bezel and the vertical walls covering the sides of the caseband The thickness of the leaf has been chosen here at 0.3 mm, but other thicknesses greater or less could likewise be suitable.

According to another characteristic of the invention the caseband-bezel is of plastic material which leads to a very inexpensive watch adapted to be manufactured in large series. But the impression of cheapness may readily be dissipated if the caseband-bezel is adorned by the cap in accordance with the invention. Thus, for instance, the "Swatch" watch (registered trademark) known worldwide for its special form and its very low price and at the same time for its quality manufacture, may constitute the caseband-bezel as defined hereinabove, such caseband-bezel to be covered with a cap thus giving to such watch a new appearance without changing its well reputed form and without substantially changing its cost of manufacture. Thus, a cap made of steel, possibly coloured, changes the the appearance of the watch, giving the impression that such watch is made of metal and this without in any manner changing the form thereof.

Finally, in general if the caseband-bezel forms a first element of the case and if the cap 5 constitutes a second element of such case, the invention is characterized by the presence of projections on one of these elements, such projections cooperating with the other element to assure hooking of said elements to one another.

Figure 2:
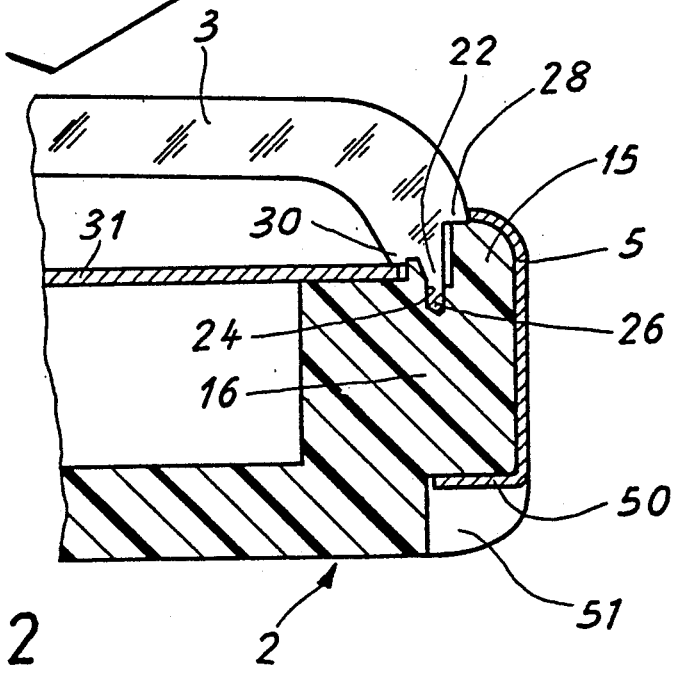
FIG. 2 is a cross-section along line II—II of FIG. 1 with the cap assembled onto the caseband-bezel.

In the first embodiment of the invention as appears on FIGS. 1 and 2 it is cap 5 which bears the projections in the form of tabs 50. Tabs 50 cooperate with corresponding receptacles 51 in the caseband 16 in order to secure the cap 5 onto the caseband-bezel 2. FIG. 2, which is a crosssection along line II—II of FIG. 1 with the cap mounted onto the caseband-bezel, shows clearly that cap 5 is hooked to the caseband 16 by bending tabs 50 into receptacles 51. It will be understood that in order to anchor the cap at least two diagonally located tabs 50 are necessary. The example of FIG. 1 shows four tabs which assures better retention of the cap.

In the examples shown on FIGS. 2 to 5, crystal 3 and caseband-bezel 2 are formed of materials which are weldable to one another. The caseband-bezel may for instance be formed of one of the materials habitually designated by ABS (acryl butadiene styrene), ASA (acryl styrene acryl-ester) or SAN (styrene acryl nitrile). The crystal is formed of a transparent acrylic resin (PMMA) commonly designated under the registered trademark "plexiglass". The crystal may be fastened in various manners to the caseband-bezel. One among others will now be briefly explained. Crystal 3 includes a lip 22 of cylindrical form engaged in a groove 24 of the caseband 16. The end of the lip 22 and the bottom of groove 24 together form a ring 26 constituted of a compound of the materials of crystal 3 and caseband-bezel 2. This ring is formed during welding by ultrasonic means of the crystal to the caseband-bezel, such welding bringing about melting of the materials of the end of the lip 22 and of the bottom of groove 24. Crystal 3 further comprises a heel 28 covering the edge of bezel 15. Another heel 30 formed on the crystal maintains the dial 31 in place.

Figure 3:
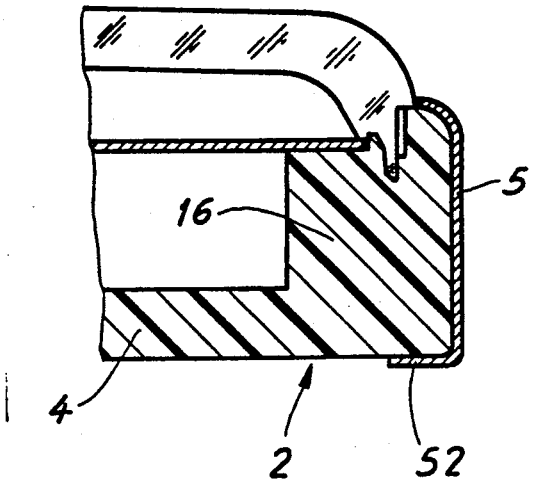
FIG. 3 is a cross-section of the watch case according to the invention and according to a first variant of the first embodiment thereof.

FIG. 3 illustrates a first variant of the embodiment shown on FIGS. 1 and 2. Here the caseband-bezel 2 does not have any receptacle and the tabs 52 of cap 5 are very simply bent under the back 4 of the caseband-bezel.

Figure 4:
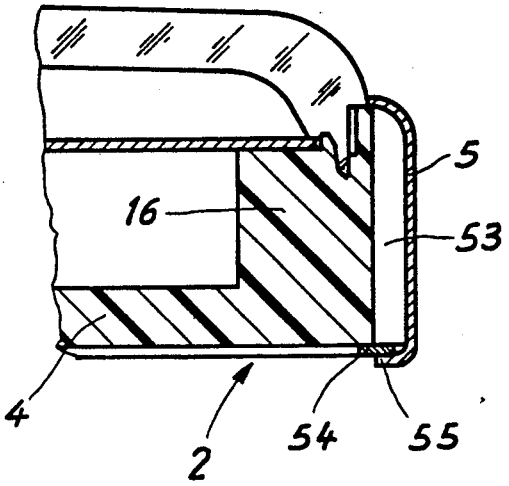
FIG. 4 is a cross-section through the watch case according to the invention and according to a second variant of the first embodiment thereof.

FIG. 4 illustrates a second variant of the embodiment shown on FIGS. 1 and 2. Here cap 5 bears projections or tabs 55 already bent before the cap is introduced onto the caseband. In order to permit such introduction, the side of the caseband 16 includes grooves 53 the section of which is dimensioned in order to allow the tabs 55 to pass. FIG. 4 shows further that the tabs 55 extend with clearance under the bottom 4 when the cap 5 is introduced as far as possible over the caseband-bezel 2. In this clearance, there is introduced a flat element to lock the cap to the caseband-bezel. This flat element may be a spring washer, such washer exhibiting a radial slot sufficiently large to enable contraction of the washer and its insertion under the tabs.

Here it will be noted that the flat element 54 could be a plate exhibiting as many notches as there are tabs on the cap. Such plate, once put into place, is rotated in a manner to secure the plate in the same manner as a bayonet-type lock.

Figure 5:
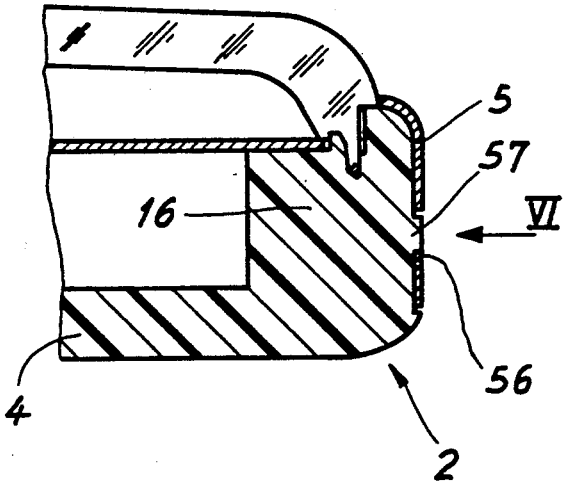
FIG. 5 is a cross-section of the watch case according to the invention and according to a second embodiment thereof.
Figure 6:
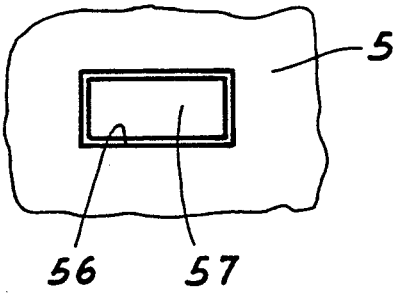
FIG. 6 is a view along arrow VI of FIG. 5.

A second embodiment of the invention is shown on FIGS. 5 and 6. In this embodiment it is the caseband-bezel 2 which bears the projections and the cap 5 which is arranged in order to cooperate with such projections. To this end caseband 16 is provided with at least two bosses 57 advantageously formed integrally with the caseband. Each boss cooperates with an opening 56 provided in the cap 5 and will be locked into said opening in order to secure the cap to the caseband-bezel. It will be appreciated that the bosses may be profitably employed in order to give a special appearance to the watch, for instance by the choice of colour employed in manufacturing the caseband-bezel.

The cap as described in the examples hereinabove could if desired cover a caseband-bezel without the latter necessarily being modified to the general dimensions necessary in view of such overlay. In the majority of cases however it will be preferable to reduce somewhat the radial dimensions of the caseband in order that the watch so covered gives the same aspect as that without cap. In such case the cap would not be extended to the bottom of the caseband as shown on FIG. 5 such cap being stopped against a flange forming part of the caseband.

A modification of the appearance of the watch at the point of sale for instance, may be effected by the merchant if he has available a reserve stock of caps. It is a simple matter to unfold the tabs shown on FIG. 1, 2 and 3 without necessarily having special tools available. The solution recommended on FIG. 4 renders the cap still more easily interchangeable since the cap already has its definitive form at the moment it is placed on the caseband-bezel. In respect of the embodiment shown on FIG. 5, it is sufficient to draw the cap over the caseband until the bosses 57 penetrate into openings 56.

What I claim is:

1. A watch case including a caseband-bezel, a crystal secured to the caseband-bezel, a cap completely overlaying the bezel and extending at least partially over the side of the caseband, an edge of the cap situated over the length of a side of the caseband having at least two projections extending with play under the caseband, and a flat locking element located between the underside of the caseband and the projections for locking said cap onto said caseband-bezel, said flat locking element comprising a flat spring washer deformable for insertion between the underside of said caseband and said projections when said projections are under said caseband.

* * * * *